US009212664B2

(12) United States Patent
Tsai et al.

(10) Patent No.: US 9,212,664 B2
(45) Date of Patent: Dec. 15, 2015

(54) RPM CONTROLLER USING DRIVE PROFILES

(75) Inventors: Chao-Ming Tsai, Tucson, AZ (US); Lynn R. Kern, Tucson, AZ (US)

(73) Assignee: STANDARD MICROSYSTEMS CORPORATION, Hauppauge, NY (US)

( * ) Notice: Subject to any disclaimer, the term of this patent is extended or adjusted under 35 U.S.C. 154(b) by 821 days.

(21) Appl. No.: 13/549,600

(22) Filed: Jul. 16, 2012

(65) Prior Publication Data

US 2012/0330464 A1 Dec. 27, 2012

Related U.S. Application Data

(62) Division of application No. 12/393,571, filed on Feb. 26, 2009, now Pat. No. 8,241,008.

(51) Int. Cl.
*F04D 27/00* (2006.01)
*G05B 13/02* (2006.01)

(52) U.S. Cl.
CPC ..... *F04D 27/00* (2013.01)

(58) Field of Classification Search
CPC ..... F04D 27/00
See application file for complete search history.

(56) References Cited

U.S. PATENT DOCUMENTS

| | | | | |
|---|---|---|---|---|
| 4,124,001 | A | 11/1978 | Samuel et al. | |
| 4,382,218 | A | 5/1983 | McVey | |
| 4,459,519 | A | 7/1984 | Erdman | |
| 4,530,395 | A | 7/1985 | Parker et al. | |
| 4,667,480 | A | 5/1987 | Bessler | |
| 4,702,413 | A | 10/1987 | Beckley et al. | |
| 4,722,669 | A | 2/1988 | Kundert | |
| 4,727,468 | A | 2/1988 | Maekawa | |
| 4,828,088 | A | 5/1989 | Mohan et al. | |
| 4,856,078 | A | 8/1989 | Konopka | |
| 4,856,286 | A | 8/1989 | Sulfstede et al. | |
| 4,860,231 | A * | 8/1989 | Ballard et al. | 702/47 |
| 4,978,896 | A | 12/1990 | Shah | |
| 5,142,286 | A | 8/1992 | Ribner et al. | |
| 5,249,741 | A * | 10/1993 | Bistline et al. | 236/49.3 |
| 5,271,558 | A | 12/1993 | Hampton | |

(Continued)

OTHER PUBLICATIONS

Taiwan Office Action, Application No. 099105471, 20 pages, Dec. 26, 2012.

(Continued)

*Primary Examiner* — Ramesh Patel
(74) *Attorney, Agent, or Firm* — Slayden Grubert Beard PLLC

(57) ABSTRACT

A control circuit for controlling the rotational speed of a fan may include a memory element to store operating data corresponding to an operational profile of the fan defined by RPM (revolutions per minute) versus temperature, with the operating data comprising a respective temperature value and a respective RPM value for each respective operating point representing a change in slope of a function that corresponds to the operational profile of the fan. A processing unit may receive a present temperature value, retrieve the operating data from the storage unit, and identify a pair of consecutive operating points corresponding to the present temperature. The processing unit may calculate a desired RPM value corresponding to the present temperature value by performing linear interpolation between the pair of consecutive operating points, and provide the desired RPM value to a closed-loop fan controller to control the fan according to the desired RPM value.

12 Claims, 5 Drawing Sheets

(56) References Cited

U.S. PATENT DOCUMENTS

| | | | | |
|---|---|---|---|---|
| 5,307,439 | A * | 4/1994 | Enami | 388/811 |
| 5,379,606 | A | 1/1995 | Katsuki et al. | |
| 5,447,414 | A | 9/1995 | Nordby et al. | |
| 5,477,827 | A * | 12/1995 | Weisman et al. | 123/436 |
| 5,511,724 | A | 4/1996 | Freiberger et al. | |
| 5,563,480 | A | 10/1996 | Okada | |
| 5,687,079 | A | 11/1997 | Bauer et al. | |
| 5,727,928 | A * | 3/1998 | Brown | 417/44.11 |
| 5,825,972 | A | 10/1998 | Brown | |
| 5,872,733 | A | 2/1999 | Buti et al. | |
| 5,896,736 | A | 4/1999 | Rajamani | |
| 5,942,866 | A | 8/1999 | Hsieh | |
| 5,945,870 | A | 8/1999 | Chu et al. | |
| 5,962,933 | A | 10/1999 | Henderson et al. | |
| 5,983,653 | A * | 11/1999 | Lee | 62/186 |
| 5,990,582 | A | 11/1999 | Henderson et al. | |
| 6,029,119 | A | 2/2000 | Atkinson | |
| 6,147,465 | A | 11/2000 | Hollenbeck | |
| 6,182,902 | B1 | 2/2001 | Shih | |
| 6,188,189 | B1 | 2/2001 | Blake | |
| 6,194,858 | B1 | 2/2001 | Chen | |
| 6,204,623 | B1 | 3/2001 | Levy et al. | |
| 6,208,538 | B1 | 3/2001 | Halamik et al. | |
| 6,211,635 | B1 | 4/2001 | Kambe et al. | |
| 6,226,324 | B1 | 5/2001 | Allstrom | |
| 6,247,898 | B1 | 6/2001 | Henderson et al. | |
| 6,262,549 | B1 | 7/2001 | Yang et al. | |
| 6,278,392 | B1 | 8/2001 | Nestler | |
| 6,313,441 | B1 | 11/2001 | Schaper et al. | |
| 6,366,049 | B1 | 4/2002 | Chen et al. | |
| 6,380,704 | B1 | 4/2002 | Chin | |
| 6,381,406 | B1 | 4/2002 | Smith et al. | |
| 6,385,395 | B1 | 5/2002 | Horng et al. | |
| 6,392,372 | B1 | 5/2002 | Mays, II | |
| 6,447,146 | B1 | 9/2002 | Skinner et al. | |
| 6,448,896 | B1 | 9/2002 | Bankus et al. | |
| 6,481,388 | B1 | 11/2002 | Yamamoto | |
| 6,481,974 | B2 | 11/2002 | Horng et al. | |
| 6,519,167 | B1 | 2/2003 | Nguyen | |
| 6,526,333 | B1 | 2/2003 | Henderson et al. | |
| 6,528,987 | B1 | 3/2003 | Blake et al. | |
| 6,563,284 | B2 | 5/2003 | Teutsch et al. | |
| 6,601,168 | B1 | 7/2003 | Stancil et al. | |
| 6,617,815 | B1 | 9/2003 | Krief | |
| 6,646,396 | B2 | 11/2003 | Brown et al. | |
| 6,650,074 | B1 | 11/2003 | Vyssotski et al. | |
| 6,661,679 | B1 | 12/2003 | Yang et al. | |
| 6,674,369 | B1 | 1/2004 | Riddoch | |
| 6,693,410 | B1 | 2/2004 | Terrien | |
| 6,703,803 | B2 | 3/2004 | Ohiwa et al. | |
| 6,737,860 | B2 * | 5/2004 | Hsu et al. | 324/161 |
| 6,747,424 | B1 | 6/2004 | Malik et al. | |
| 6,757,592 | B1 * | 6/2004 | Henderson et al. | 700/299 |
| 6,765,422 | B1 | 7/2004 | Aslan et al. | |
| 6,778,938 | B1 | 8/2004 | Ng et al. | |
| 6,793,879 | B2 | 9/2004 | Bayer et al. | |
| 6,809,497 | B2 | 10/2004 | Kudo et al. | |
| 6,812,737 | B2 | 11/2004 | Sueyoshi et al. | |
| 6,815,916 | B2 | 11/2004 | Horng et al. | |
| 6,874,327 | B1 * | 4/2005 | Wahler et al. | 62/178 |
| 6,879,120 | B2 | 4/2005 | Xi | |
| 6,885,160 | B2 | 4/2005 | Takeuchi | |
| 6,919,703 | B2 | 7/2005 | Marando et al. | |
| 6,924,568 | B2 | 8/2005 | Dhuey | |
| 6,933,697 | B2 | 8/2005 | Marando et al. | |
| 6,997,684 | B2 | 2/2006 | Hahn et al. | |
| 7,026,775 | B2 | 4/2006 | Kokubo et al. | |
| 7,029,239 | B2 | 4/2006 | Marando et al. | |
| 7,038,408 | B2 | 5/2006 | Lin et al. | |
| 7,048,199 | B2 * | 5/2006 | Melink | 236/49.3 |
| 7,064,511 | B2 | 6/2006 | Marando et al. | |
| 7,069,172 | B2 | 6/2006 | Bekker et al. | |
| 7,075,261 | B2 | 7/2006 | Burstein | |
| 7,076,159 | B2 | 7/2006 | Bekker | |
| 7,092,623 | B2 | 8/2006 | Bekker | |
| 7,096,134 | B2 | 8/2006 | Miller, Jr. | |
| 7,109,670 | B1 | 9/2006 | Rehm | |
| 7,132,809 | B1 | 11/2006 | Chang | |
| 7,135,826 | B2 * | 11/2006 | Ma et al. | 318/49 |
| 7,138,781 | B2 * | 11/2006 | Murray et al. | 318/400.04 |
| 7,151,349 | B1 | 12/2006 | Williamson et al. | |
| 7,211,977 | B2 | 5/2007 | Squibb | |
| 7,218,073 | B2 | 5/2007 | Huang et al. | |
| 7,245,095 | B2 | 7/2007 | Hsu | |
| 7,279,857 | B2 | 10/2007 | Babb et al. | |
| 7,295,897 | B2 | 11/2007 | Marando et al. | |
| 7,340,367 | B2 | 3/2008 | Inoue et al. | |
| 7,362,060 | B2 | 4/2008 | Tembreull et al. | |
| 7,407,046 | B2 | 8/2008 | Bhat et al. | |
| 7,550,936 | B2 | 6/2009 | Kurita | |
| 2003/0011332 | A1 | 1/2003 | Mays, II | |
| 2003/0137267 | A1 | 7/2003 | Blake | |
| 2003/0175124 | A1 | 9/2003 | Hahn et al. | |
| 2003/0193307 | A1 | 10/2003 | Burstein | |
| 2003/0234630 | A1 | 12/2003 | Blake | |
| 2004/0001542 | A1 | 1/2004 | Miller, Jr. | |
| 2004/0234376 | A1 | 11/2004 | Marando et al. | |
| 2005/0040777 | A1 | 2/2005 | Bekker | |
| 2005/0156544 | A1 | 7/2005 | Marando et al. | |
| 2005/0186083 | A1 | 8/2005 | Marando et al. | |
| 2005/0238336 | A1 | 10/2005 | Bekker | |
| 2005/0256670 | A1 | 11/2005 | Bekker et al. | |
| 2007/0075675 | A1 * | 4/2007 | Hsu | 318/812 |
| 2007/0162160 | A1 * | 7/2007 | Chang et al. | 700/25 |
| 2008/0036403 | A1 | 2/2008 | Ma et al. | |
| 2008/0088263 | A1 | 4/2008 | Lee | |
| 2008/0088463 | A1 * | 4/2008 | Wu et al. | 340/584 |
| 2008/0095521 | A1 | 4/2008 | Chen et al. | |
| 2008/0170947 | A1 * | 7/2008 | Sutardja | 417/32 |
| 2009/0167220 | A1 | 7/2009 | Kanamori | |
| 2010/0017039 | A1 | 1/2010 | Han et al. | |

OTHER PUBLICATIONS

Johns et al.; "Analog Integrated Circuit Design;" John, Wiley & Sons, 1996; p. 550.

Liu; "Tutorial on Designing Delta-Sigma Modulators: Part 1;" CommsDesign, Mar. 30, 2004, retrieved from Internet: <http://www.commsdesign_com/showArticle_ihtml?articleID=18402743>; 22 pages.

"dBCOOL Remote Thermal Controller and Voltage Monitor—ADM1027;" Analog Devices, 2003; 56 pages.

"LM63: ±1° C/±3° C Accurate Remote Diode Digital Temperature Sensor with Integrated Fan Control;" National Semiconductor Corporation, May 2003; 28 pages.

Ohr; "Analog IC vendors find 'Intel Inside' a safe bet;" EE Times, retrieved from Internet: <http://www.eetimes.com/electronics-news/4166002/Analog-IC-vendors-find-Intel-Inside-a-safe-bet>, Sep. 12, 2002; 3 pages.

* cited by examiner

| $T_0$ | $T_1$ | $T_2$ | $T_3$ | $T_4$ | $T_5$ | $T_6$ |
|---|---|---|---|---|---|---|
| Comparison | Choose Slot | $B=t_k$ | $B=t_1$ | $B=r_1$ | if DR[7]=1 | if DR[6]=1 |
| | | $A=t_0$ | $A=t_0$ | $A=t_0$ | $A=t_{K0}$ | $A=t_{K0}$ |
| | Set | Code | Code | Code | else | else |
| | $(t_0,r_0)$ | =110 | =110 | =110 | A=0 | A=0 |
| | $(t_1,r_1)$ | $t_{k0}$=Acc | DT=Acc | DR=Acc | B=0 | B=Acc |
| | | | | | Code=001 | Code=001 |
| | | Calculate $t_{k0}= t_k - t_0$ | Calculate $DT = t_1 - t_0$ | Calculate $DR= r_1 - r_0$ | Calculate $t_{k0}*DR[7]$ | Calculate $t_{k0}*DR[7] * 2 + t_{k0}*DR[6]$ |

FIG. 5

RPM CONTROLLER USING DRIVE PROFILES

PRIORITY CLAIM

This application is a divisional application of U.S. patent application Ser. No. 12/393,571 titled "RPM Controller Using Drive Profiles" filed Feb. 26, 2009, now U.S. Pat. No. 8,241,008 whose inventors are Chao-Ming Tsai and Lynn R. Kern, and which is hereby incorporated by reference in its entirety as though fully and completely set forth herein.

BACKGROUND OF THE INVENTION

1. Field of the Invention

This invention relates generally to the field of digital circuit design and, more particularly, to the design of an RPM controller.

2. Description of the Related Art

Fans are often used to evacuate warm air from enclosures in which electronic systems are contained. For example, most computer systems include one or more cooling fans to aid in circulating the air inside the enclosures and for maintaining the temperature inside the enclosures within an acceptable range. The increased airflow provided by fans typically aids in eliminating waste heat that may otherwise build up and adversely affect system operation. Employing cooling fans is especially helpful in ensuring proper operation for certain central processing units (CPUs) with relatively high operating temperatures.

Control of fans in a system typically involves a fan control unit executing a fan control algorithm. A fan control algorithm may determine the method for controlling one or more fans that are configured to evacuate warm air from a system enclosure. For example, the fan control algorithm may specify that a fan's rotational speed should be increased or decreased dependent upon a detected temperature. Such control algorithms may also involve turning off a fan if the temperature is deemed cool enough to do so, or in certain systems, such as personal computers (PCs) for example, lowering the rotational speed of the fan and allowing the fan to continue running at a minimum rotational speed.

For detecting the temperature, a temperature sensor may provide to the fan control unit a signal indicative of the current temperature of a particular temperature zone in the electronic system. Often, fans used for CPU and/or computer system cooling have a three-wire interface with wires for power, ground, and a tachometer signal. Fan drive systems often use a signal generator that provides a Pulse Width Modulated (PWM) signal to drive an external circuit that controls the voltage between the power and ground interfaces of the fan, which in turn controls the speed of the fan. Signal generators that provide PWM signals are useful because they provide a digital control for the pulse width of a signal. The fan is typically powered only for the duration of the pulse. Between pulses power to the fan is turned off, although the fan is typically still spinning during this time. The duty cycle of the PWM pulse train currently being provided to the fan determines the fan's speed. Another typical way to control three-wire fans is to drive the fan by utilizing a high side Field Effect Transistor (FET), thereby controlling the DC voltage supplied to the fan. Generally, this provides an effective dynamic control range of 3V, which typically ranges from 5V down to around 2V. The lower limit voltage (2V) is still sufficient to power the fan circuitry, and valid tachometer signals may still be obtained from the fan.

Alternatively, some computer systems use fan control circuitry that features a 4-wire fan interface, where the fourth wire typically carries an additional control signal from the system to the fan. Thus, for fan drive systems that use PWM signal generators, in addition to the power, ground, and tachometer signal, a four-wire fan will typically have a PWM-drive input, which is used to control the speed of the fan. In such systems, instead of switching the power to the entire fan on and off, generally only the power to the drive coils is switched, making the tachometer information available continuously. Another advantage of 4-wire fans is that the fan speed can typically be controlled at speeds as low as 10% of the fan's full speed. Many PC desktop and workstation cooling fan solutions today use open loop 4-wire fan control methods, or are thermistor based, where a thermistor is integrated into the fan.

Typically when an open-loop four-wire cooling fan control method is used, two fan curves are specified. The first is generally a desired Temperature-versus-PWM curve, and the second is usually a PWM-versus-RPM (Revolutions Per Minute—an indication of rotational fan speed) curve. Many currently available fan control devices implement the Temperature-versus-PWM curve, and the cooling fans must generally follow the tightly specified PWM-versus-RPM curve. Open loop four-wire fan control systems thus have to rely on the tight fan specifications supplied by the fan manufacturer in order to achieve the desired fan RPM for a given PWM command.

In addition, in most cases, merely driving the fan with a prescribed duty cycle may not facilitate correcting for fan aging, pressure changes, and other conditions that might affect the performance of the fan over time. Most present day solutions address these issues using analog comparators and RC ramps to create a continuous function with varying duty cycle, to control either a PWM input to a fan, or the drive voltage applied externally to the fan. Therefore, alternative fan control methods may be preferred for driving the fan, while retaining digital control of the fan. For example, it may be desirable to provide closed loop RPM (revolutions per minute) control. When RPM control is used, however, the ability to control the RPM in a closed loop may require every operational point along the desired operational profile of a given fan, which usually requires that all operational points be stored (to be used by the controller), which may lead to excessive memory requirements. For example, in most systems, two Bytes may be required to store operating (control) data for each temperature point for which control of the fan is desired.

Other corresponding issues related to the prior art will become apparent to one skilled in the art after comparing such prior art with the present invention as described herein.

SUMMARY OF THE INVENTION

In one set of embodiments, closed-loop RPM (revolutions per minute) control of a fan may be achieved with only a limited number of data points from the desired operational RPM vs. Temperature profile being stored. In order to reduce the amount of memory storage required to store a complete operational profile, only starting operating points and intermediate operating points that correspond to a change in slope of the overall operational profile (RPM vs. Temperature profile function) of a given fan may be stored. A linear interpolation between the stored operating data points may be performed for continuous operation across the temperature range. Various embodiments of the closed-loop autonomous RPM control disclosed herein may facilitate limiting the effects of fan aging, while allowing for a linear interpolation or step response.

One method for powering a fan may therefore include storing operating points corresponding to an RPM versus temperature operational profile function (RTPF) of the fan, with each operating point comprising a respective temperature value and a corresponding respective RPM value, and each operating point representing a change in slope of the RTPF, with each pair of consecutive operating points defining a respective temperature slot. The method may further include receiving a present temperature value indicative of a present temperature reading, selecting a matching temperature slot corresponding to the present temperature value, where the present temperature value is greater than a lower respective temperature value of a pair of consecutive operating points that defines the matching temperature slot, and lower than a higher respective temperature value of the pair of consecutive operating points that defines the matching temperature slot. The desired RPM value may then be calculated by performing interpolation between the pair of consecutive operating points that defines the matching temperature slot, and the rotational speed of the fan may be controlled according to the calculated desired RPM value and a present RPM value indicative of a present RPM of the fan.

In one set of embodiments, a control circuit for controlling the rotational speed of a fan may include a storage unit to store operating data corresponding to an operational profile of the fan defined by RPM versus temperature function (RTPF), with the operating data including a respective temperature value and a respective RPM value for each respective operating point representing a change in slope of the RTPF, with each pair of consecutive operating points defining a respective temperature slot. The control circuit may further incorporate a processing unit configured to communicate with the storage unit to retrieve the operating data, receive a present temperature value indicative of a present temperature reading, select a matching temperature slot corresponding to the present temperature value—where the present temperature value is greater than a lower respective temperature value of a pair of consecutive operating points that defines the matching temperature slot, and lower than a higher respective temperature value of the pair of consecutive operating points that defines the matching temperature slot—calculate a desired RPM value according to a specified algorithm and the pair of consecutive operating points that defines the matching temperature slot, and output the desired RPM value to a closed-loop fan controller. The closed-loop fan controller may receive a feedback signal indicative of a present speed of the fan, and control a rotational speed of the fan according at least to the feedback signal and the desired RPM value.

A computer system may include a fan, memory configured to store operating data corresponding to an RPM versus temperature operational profile function (RTPF) of the fan, with the operating data comprising a respective temperature value and a respective RPM value for each respective operating point representing a change in slope of the RTPF of the fan, with each pair of consecutive operating points defining a respective temperature slot. The computer system may further include a processing unit to receive a present temperature value indicative of a present temperature reading, retrieve the operating data from the memory, and identify a present temperature slot corresponding to the present temperature value. The present temperature value may be greater than a lower respective temperature value of a pair of consecutive operating points that defines the present temperature slot, and lower than a higher respective temperature value of the pair of consecutive operating points that defines the present temperature slot. The processing unit may then calculate a desired RPM value according to a specified algorithm and the pair of consecutive operating points that defines the present temperature slot, and output the desired RPM value to a closed-loop fan controller configured to also receive a feedback signal indicative of a present speed of the fan, and control a rotational speed of the fan according at least to the feedback signal and the desired RPM value.

In one set of embodiments, the specified algorithm may be executable to perform linear interpolation between the pair of consecutive operating points that defines the present temperature slot to obtain the desired RPM value. Accordingly, the processing unit may include a comparator configured to compare the present temperature value to various ones of the respective temperature values of the stored operating points to identify which present temperature slot corresponds to the present temperature value, and the processing unit may be configured with an arithmetic logic unit (ALU) to implement the linear interpolation. The processing unit may further be configured to receive one or more environmental parameter readings, and adjust the desired RPM value according to the one or more environmental parameter readings prior to outputting the desired RPM value. In various embodiments, the system may include additional fans, each fan having its own operational profile based on which a respective desired RPM of the fan may be calculated/interpolated as described above.

Other aspects of the present invention will become apparent with reference to the drawings and detailed description of the drawings that follow.

BRIEF DESCRIPTION OF THE DRAWINGS

The foregoing, as well as other objects, features, and advantages of this invention may be more completely understood by reference to the following detailed description when read together with the accompanying drawings in which:

FIG. 5 shows a first segment of a timeline detailing operation of the ALU of FIG. 4.

Figure 1:
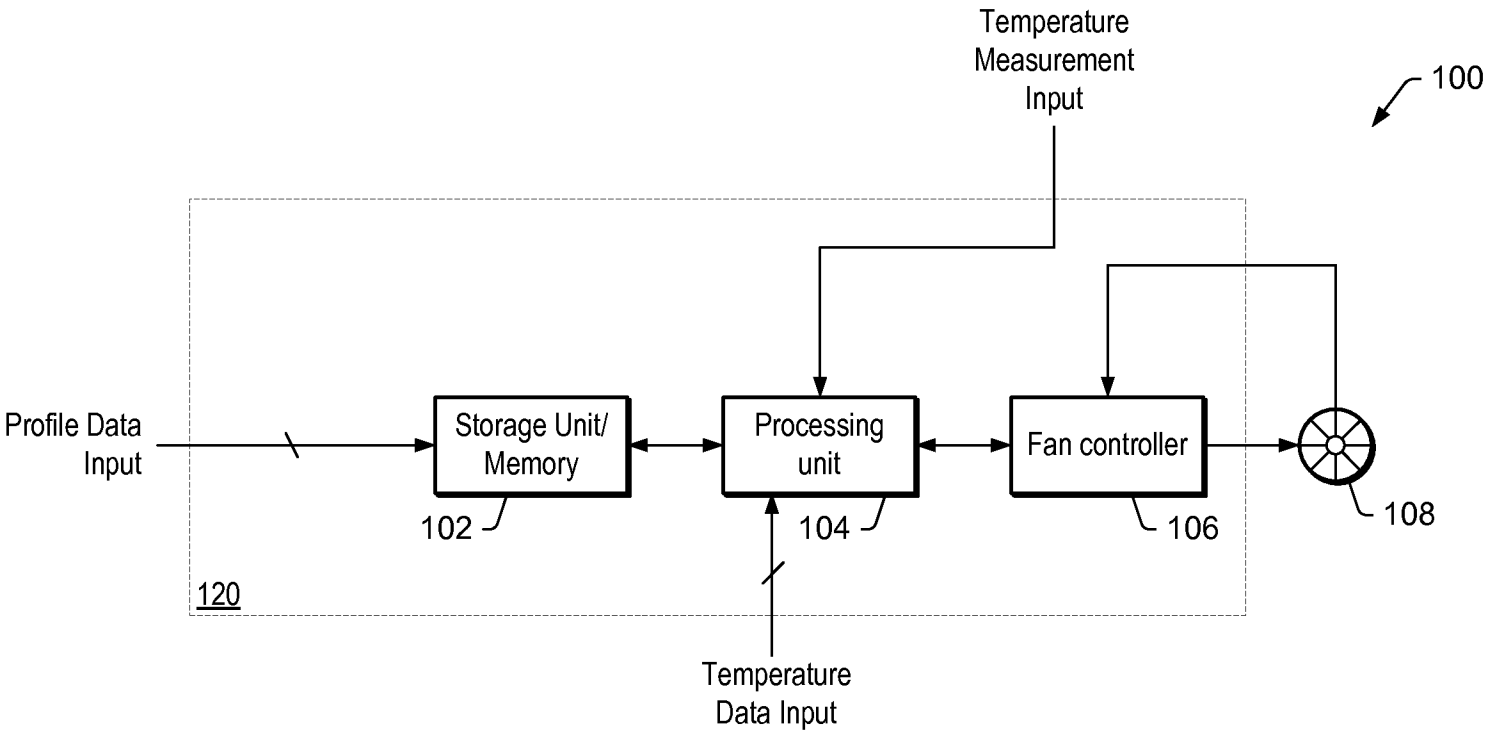
FIG. 1 shows a simplified block diagram of one embodiment of a fan system and fan control circuit.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "coupled" means "directly or indirectly connected".

DETAILED DESCRIPTION OF THE PREFERRED EMBODIMENTS

As used herein, when referencing a pulse of a signal, a "leading edge" of the pulse is a first edge of the pulse, resulting from the value of the signal changing from a default value, and a "trailing edge" is a second edge of the pulse, resulting from the value of the signal returning to the default value. A first signal is said to be "corresponding" to a second signal if the first signal was generated in response to the second signal. When data is said to be "registered" or "latched" "using" a signal, the signal acts as a trigger signal that controls the storing of the data into the register or latch. In other words, when a signal "used" for registering or latching data is in its triggering state, the data residing at respective input ports of the register or latch is stored into the register or latch. Similarly, when data is latched "on the leading edge" or "on the trailing edge" of a pulse of a clock, the data residing at respective input ports of a register or latch is stored into the register or latch, respectively, when a leading edge or a trailing edge of a pulse of the clock occurs, respectively. A first signal is said to "propagated based on" a second signal, when the second signal controls the propagation of the first signal. Similarly, a first module is said to "use" a clock signal to transfer data to a second module, when propagation of the data from the first module to the second module is controlled and/or triggered by the clock signal. When referencing a binary number, the least significant bit (LSB) is understood to be the rightmost bit of the binary number, whereas the most significant bit (MSB) is understood to be the leftmost bit of the binary number. For example, in case of the binary number '011' the LSB would be '1' while the MSB would be '0'.

FIG. 1 shows a simplified system diagram of a fan system 100 that includes a control circuit 120 for controlling and powering a fan 108 through a closed-loop fan controller 106, which may be a closed-loop RPM controller. Control circuit 120 may be designed using digital design techniques, resulting in a testable, accurate circuit on a smaller die size. As shown in FIG. 1, a temperature reading (temperature measurement input) may be provided as input to processing unit 104, which may operate according to an RPM-versus-temperature profile function (RTPF), which may be stored in storage unit 102, and generate and output a desired fan RPM value corresponding to the input temperature reading to fan controller 106. In one sense, the RTPF may be considered an operational profile function implementing RPM as a function of temperature. The RTPF may be configurable by the user, and may correspond to a desired fan profile for any given fan, for example fan 108. Thus, there may be more than one RTPFs stored within storage unit 102, depending on the number of supported fans, and more than one fan may be coupled to fan controller 106, which may provide more than one fan control signal. In addition, processing unit 104 may be configured to receive additional parameter readings, for example ambient audio, etc. and generate the desired RPM value by also taking into account those additional parameter readings.

Various different RPM-versus-temperature profiles may be selected and used when actually controlling fan 108. In one embodiment, fan controller 106 operates to keep the speed of cooling fan 108 considerably close to desired RPM value, thereby providing stability for a wide variance of fan responses. In one set of embodiments, the desired RPM value may be compared to a sensed value of the actual speed of cooling fan 108 provided in the feedback loop from fan 108 to fan controller 106. A resulting error signal may be used with, for example, a compensator in order to drive the actual speed of cooling fan 108 to the desired RPM value. In some embodiments, depending on the type of fan used, instead of providing the fan control signal directly to fan 108, fan controller 106 may provide the fan control signal to a fan drive circuit, which may be configured to generate a set of one or more fan control signals that is provided to cooling fan 108 to drive a motor, which may be a brushless DC fan motor, comprised in cooling fan 108 towards the desired RPM value.

As previously mentioned, control circuit 120 may be configured to store, in storage unit 102 for example, a respective operational profile for one or more specified fans. Each operational profile might contain operating points each defined by a desired RPM of the fan for a given measured temperature. The RPM values may be related to the temperature values according to the desired cooling effect the rotating fan is expected to provide. In order to reduce the amount of storage required in storage unit 102 to store an entire operational profile for any given fan, only certain specified operating points of the operational points may be defined and stored. More specifically, the specified operating points stored may comprise only starting operating points and intermediate operating points where the slope of the RPM vs. Temperature function within the operational profile of a specified fan changes. Continuous operation over the operating temperature range may be achieved by performing linear interpolation between stored data points to obtain an actual operating point from which a present, desired RPM value of the fan may be derived. In addition, the desired RPM value thus obtained through interpolation may be slightly modified according to additional parameter readings, and/or inputs, as required by system considerations.

Storage unit 102 may thus be configured to store a number of operating points corresponding to the operational profile of a specified fan. The operating points may be only those operating points where the slope of the RPM vs. Temperature function within the operational profile changes. Data may be stored in storage unit 102 through the profile data input. Processing unit 104 may be configured to communicate with storage unit 102 and closed loop fan controller 106, to perform the interpolation and extract the RPM value based on the stored operating points and present (measured) temperature. In one set of embodiments a temperature measurement value from a temperature sensor may be may provided to fan controller 106, while in other embodiments the temperature measurement value may be provided directly into processing unit 104. A feedback signal indicative of the speed of fan 108 may be provided from fan 108 to fan controller 106 to establish closed loop control of fan 108. In one set of embodiments, control circuit 120 may be configured on an integrated circuit comprising pins for receiving the temperature measurement value, profile data and fan speed feedback input. In one set of embodiments, processing unit 104 may be an arithmetic logic unit configured to implement the necessary functions to perform the required interpolation, while in other embodiments processing unit 104 may be implemented as a finite state machine or microcontroller. Various other embodiments to implement control circuit 120 are possible and are contemplated.

Figure 2:
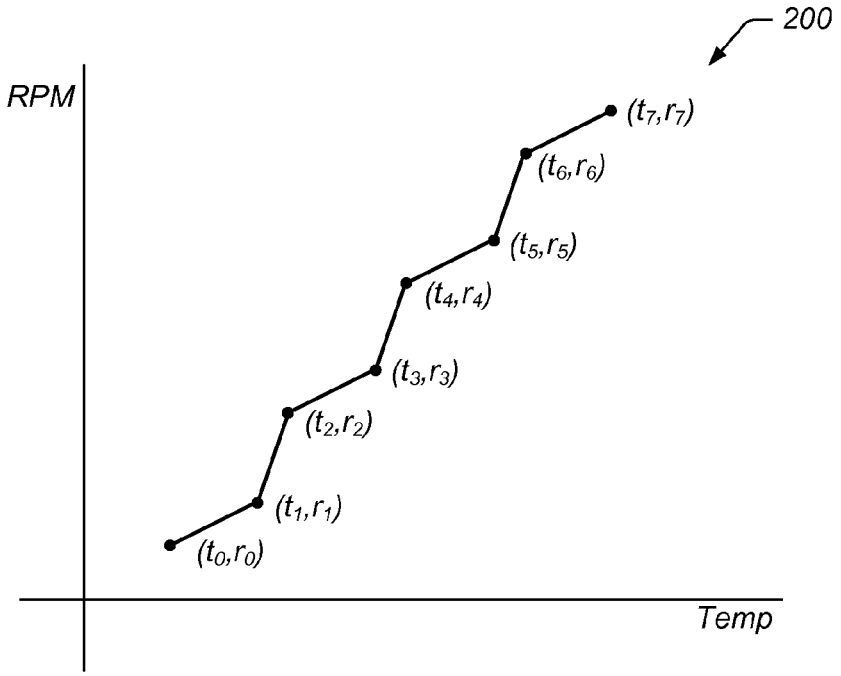
FIG. 2 shows one example of an RPM vs. Temperature operational profile for a fan, with a reduced number of operating points.

FIG. 2 shows an RPM versus temperature function curve 200 illustrating how only a reduced number of operating points corresponding to the operational profile of a specified fan may be required, and may need to be stored. In the example of function curve 200, eight operating points may be stored in storage unit 102. Those skilled in the art will appreciate that the number of operating points will vary depending on the fan profile, and function curve 200 is meant to be representative of only one example. In function curve 200, each operating point ($t_i$, $r_i$) represents a stored profile operating point. When a new temperature measurement is received, an appropriate slot—representing a section between two operating points—may be selected according to the measured temperature value. For example, if the temperature scale is in 10° C. increments, $t_0$=10° C., $t_1$=20° C., $t_2$=30° C., etc., and the value of a present temperature measurement is 22° C., then the slot between $t_1$ and $t_2$ may be selected. In other words, the segment or section of the profile curve between operating points ($t_1$, $r_1$) and ($t_2$, $r_2$) may be used to obtain the RPM value that corresponds to the measured temperature value of 22° C.

Figure 3:
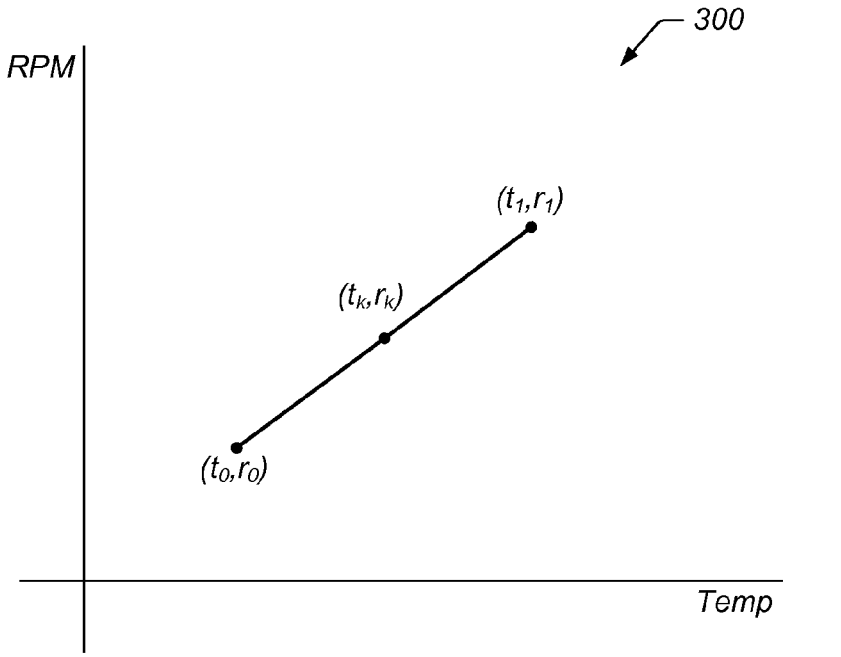
FIG. 3 shows one example of interpolation between successive operating points on an RPM vs. Temperature such as the RPM vs. Temperature curve of FIG. 2.

In one set of embodiments, a present temperature reading $t_k$ may be received, and if no stored operating point ($t_i$, $r_i$) such that $t_i$=$t_k$ may be found, two stored operating points ($t_0$, $r_0$ and $t_1$, $r_1$) corresponding to the temperature reading may be selected, such that $t_0<t_k<t_1$, and a desired RPM value may be calculated according to a specified formula, which may be an interpolation algorithm. FIG. 3 shows an example of one possible segment from the function curve corresponding to the operational profile of a specified fan shown in FIG. 2. The present temperature reading $t_k$ may be compared against $t_i$ values which may be part of stored operating points, and upon determination that $t_0<t_k<t_1$, the boundaries for calculating the desired RPM value may be set to the operating points $t_0$, $r_0$ and $t_1$, $r_1$. The desired RPM value $r_k$ corresponding to $t_k$ may then be determined according to:

$$r_k = r_0 + \frac{r_1 - r_0}{(t_1 - t_0) * (t_k - t_0)},$$

which may be expressed as $$r_k = r_0 + \frac{DR * t_{ko}}{DT},$$

where $$DR = r_1 - r_0,$$

$$DT = t_1 - t_0, \text{ and}$$

$$t_{k0} = t_k - t_0.$$

Figure 4:
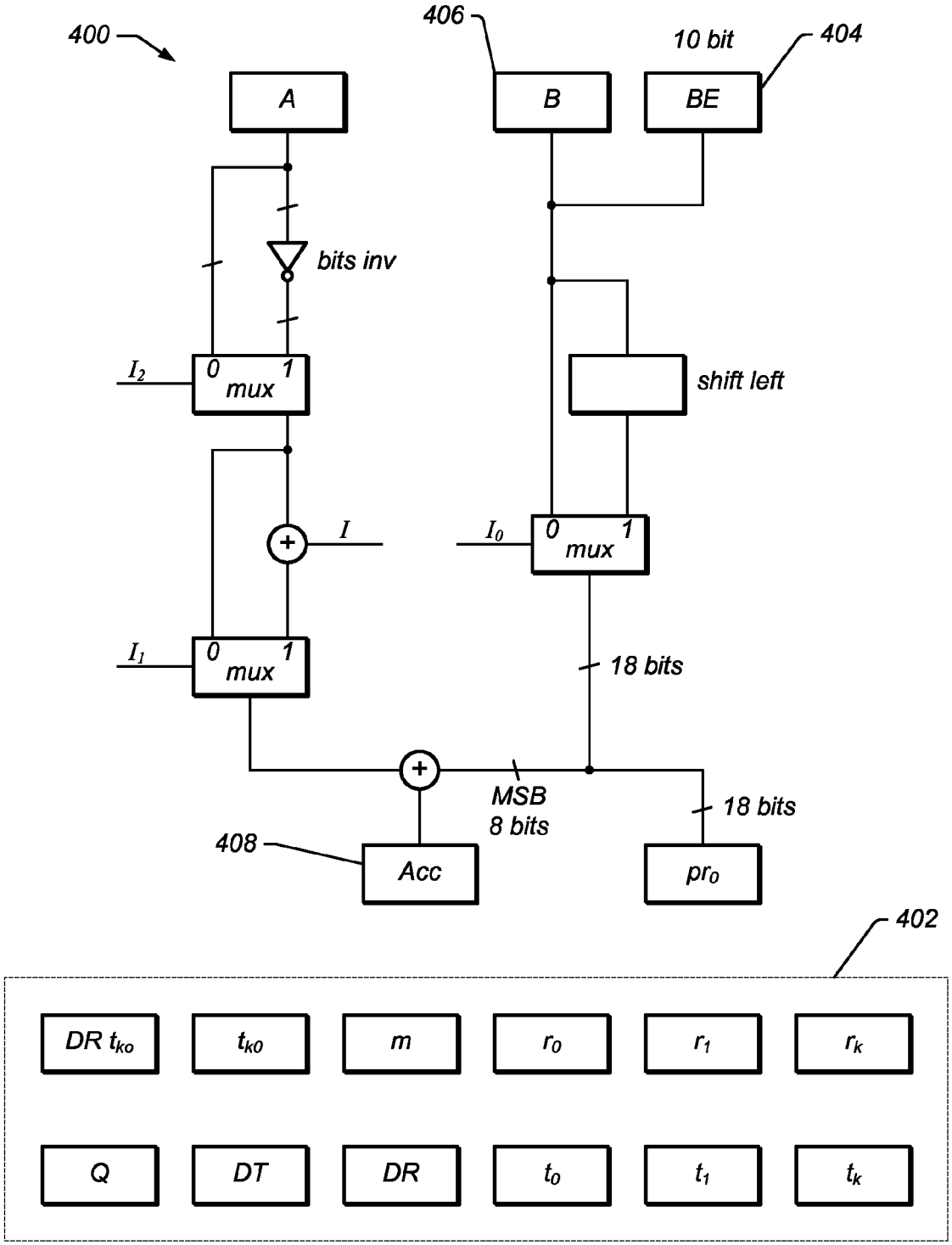
FIG. 4 shows a logic diagram of one embodiment of an ALU configured to implement linear interpolation.
Figure 6:
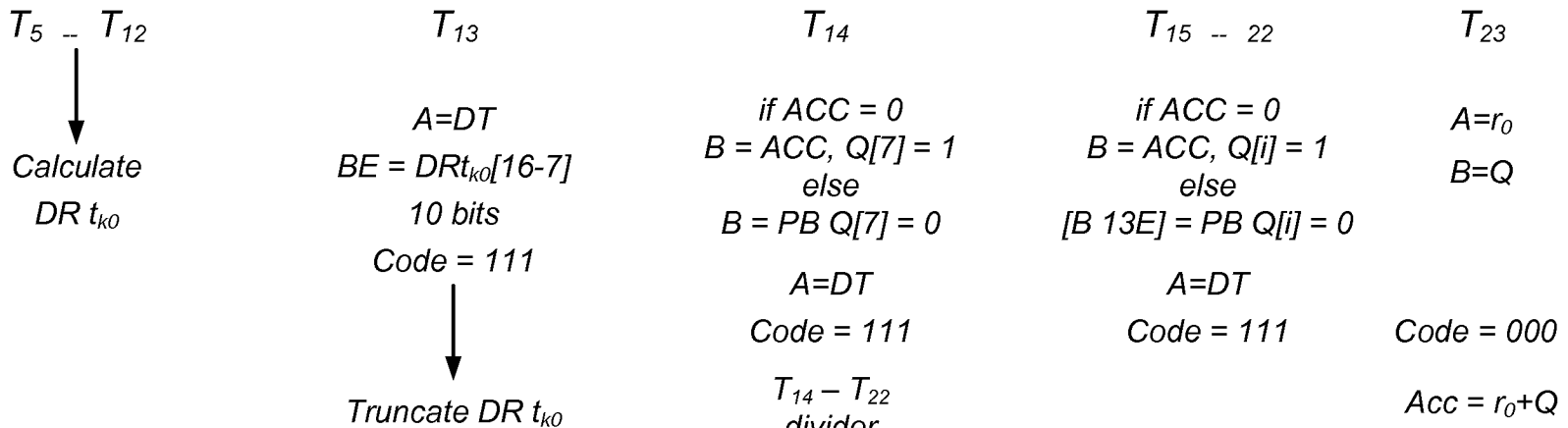
FIG. 6 shows a second segment of a timeline detailing operation of the ALU of FIG. 4.

In one set of embodiments, the formula (algorithm) for the interpolation as shown above, may be implemented with an arithmetic logic unit (ALU), one embodiment of which is shown in FIG. 4 as ALU 400. Registers 402 may be used to hold the various operands used by ALU 400 to perform the necessary operations to calculate the desired value of RPM. Registers 420 may be part of storage unit 102, or they may be part of processing unit 104, which may include ALU 400. In some embodiments, registers 420 and ALU 400 may be configured on the same integrated circuit as fan controller 106. FIGS. 5 and 6 show one embodiment of a timeline of the operation of ALU 400 for calculating the desired value of RPM based on the stored operating points and the present temperature measurement.

As shown in FIGS. 5 and 6, a comparison may be performed at time $T_0$, to determine which slot to select for the interpolation. Following the slot determination, at time $T_1$ the boundaries may be set by specifying ($t_0$, $r_0$) and ($t_1$, $r_1$). Subsequently, DR, DT, and $t_{ko}$ may be calculated during time period $T_2$ through $T_4$. DR*$t_{ko}$ may be calculated during time period $T_5$ through $T_{12}$. The product given by ((((((($t_{ko}$*DR[7]*2+$t_{ko}$*DR[6])*2+$t_{ko}$*DR[5])*2+$t_{ko}$*DR[4])*2+$t_{ko}$*DR[3])*2+$t_{ko}$*DR[2])*2+$t_{ko}$*DR[1])*2+DR[0] may be implemented as a shift-left and add operation. (DR*$t_{ko}$)/DT may be calculated during time period $T_{14}$ through $T_{22}$, as shown in FIG. 6.

Referring again to FIG. 4, BE registers 404 may be used for 10-bit floating points. The most significant bit (MSB) 10 bits of (DR*$t_{ko}$) from registers 402 may be moved to BE 404. The concatenated bit contents of registers B 406 and BE 404 {B, BE} may be shifted left, and the content of register DT (from registers 402) may be subtracted. At this point, if the sum is larger than zero, the quotient (Q) in this position may be 1, and the next {B, BE} may become the sum. Otherwise, if the sum is smaller than zero, the quotient in this position may be 0, and the next {B, BE} may retain its previous value. This procedure may be repeated until time point $T_{22}$, at which point the 8-bit quotient would now be calculated. At time $T_{23}$, ($r_0$+(DR*$t_{ko}$)*DT) may be calculated, resulting in accumulator Acc 408 holding the desired value of RPM.

Various embodiments of a closed-loop autonomous RPM control disclosed herein may therefore be configured to limit the effects of fan aging on fan control accuracy, while reducing storage requirements for storing operating points corresponding to an operational profile of the specified, controlled fan. The RPM control may be configured with a programmable linear/step response to allow for performing linear interpolation or applying a step control to the controlled fan. It should also be noted that while FIG. 1 only illustrates a single fan, various embodiments may be adapted to control more than one fan, the desired RPM for each fan calculated according to a respective RPM vs. Temperature profile stored for each fan as set forth herein.

Although the embodiments above have been described in considerable detail, other versions are possible. Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

We claim:

1. A control circuit for controlling the rotational speed of a fan, the control circuit comprising:

a storage unit to store operating data corresponding to an operational profile of the fan defined by an RPM (revolutions per minute) versus temperature function (RTPF), wherein the operating data comprises a respective temperature value and a respective RPM value for each respective operating point representing a change in slope of the RTPF, wherein each pair of consecutive operating points defines a respective temperature slot; and a processing unit configured to:

communicate with the storage unit to retrieve the operating data;

receive a present temperature value indicative of a present temperature reading;

calculate a desired RPM value, wherein a corresponding operating point is identified when the present temperature value matches one of the respective temperature values of the stored operating points, and the desired RPM value is set to the respective RPM value corresponding to the matching one of the respective temperature values; select a matching temperature slot when the present temperature value does not match any of the respective temperature values of the stored operating points, wherein a pair of consecutive operating points corresponding to the present temperature value is identified, wherein the present temperature value is greater than a lower respective temperature value of the pair of consecutive operating points that defines the matching temperature slot, and lower than a higher respective temperature value of the pair of consecutive operating points that defines the matching temperature slot;

calculate a desired RPM value according to a specified algorithm and the pair of consecutive operating points that defines the matching temperature slot; and output the desired RPM value.

2. The control circuit of claim 1, further comprising a closed-loop fan controller configured to:

receive a feedback signal indicative of a present speed of the fan;

receive the desired RPM value; and control a rotational speed of the fan according at least to the feedback signal and the desired RPM value.

3. The control circuit of claim 1, wherein the calculation unit comprises:

a storage unit configured to hold the operating data; and a processing unit configured to receive the present temperature value and calculate the desired RPM value according to the specified algorithm.

4. The control circuit of claim 3, wherein the specified algorithm is an interpolation algorithm, and the processing unit is an arithmetic logic unit (ALU) configured to implement the interpolation algorithm.

5. The control circuit of claim 1, wherein the control circuit is configured on an integrated circuit.

6. The control circuit of claim 1, wherein the processing unit is further configured to:

receive one or more additional parameter values corresponding to one or more respective parameter readings; and modify the desired RPM value according to the one or more parameter values before providing the desired RPM value.

7. A computer system comprising:

a fan;

memory configured to store operating data corresponding to an RPM (revolutions per minute) versus temperature operational profile function (RTPF) of the fan, wherein the operating data comprises a respective temperature value and a respective RPM value for each respective operating point representing a change in slope of the RTPF, wherein each pair of consecutive operating points defines a respective temperature slot; and a processing unit configured to:

retrieve the operating data from the memory;

receive a present temperature value indicative of a present temperature reading;

calculate a desired RPM value, wherein a corresponding operating point is identified when the present temperature value matches one of the respective temperature values of the stored operating points, and the desired RPM value is set to the respective RPM value corresponding to the matching one of the respective temperature values;

identify a present temperature slot when the present temperature value does not match any of the respective temperature values of the stored operating points, wherein a pair of consecutive operating points corresponding to the present temperature value is identified, wherein the present temperature value is greater than a lower respective temperature value of the pair of consecutive operating points that defines the present temperature slot, and lower than a higher respective temperature value of the pair of consecutive operating points that defines the present temperature slot;

calculate a desired RPM value according to a specified algorithm and the pair of consecutive operating points that defines the present temperature slot; and output the desired RPM value; and closed-loop fan controller configured to:

receive a feedback signal indicative of a present speed of the fan;

receive the desired RPM value; and control a rotational speed of the fan according at least to the feedback signal and the desired RPM value.

8. The system of claim 7, wherein the specified algorithm is executable to perform linear interpolation between the pair of consecutive operating points that defines the present temperature slot to obtain the desired RPM value.

9. The system of claim 8, wherein the processing unit comprises:

a comparator configured to compare the present temperature value to various ones of the respective temperature values of the stored operating points to identify which present temperature slot corresponds to the present temperature value.

10. The system of claim 8, wherein the processing unit comprises:

an arithmetic logic unit (ALU) configured to implement the linear interpolation; and a set of registers configured to store at least a portion of the data used in the ALU operations.

11. The system of claim 7, wherein the processing unit is further configured to receive one or more environmental parameter readings, and adjust the desired RPM value according to the one or more environmental parameter readings prior to outputting the desired RPM value.

12. The system of claim 7, further comprising one or more additional fans, wherein the memory is further configured to store additional operating data corresponding to a respective RTPF for each of the one or more additional fans;

wherein for each respective fan of the one or more additional fans, the processing unit is further configured to:

identify a respective present temperature slot when the respective present temperature value does not match any of the respective temperature values of the stored operating points, wherein a pair of consecutive operating points corresponding to the present temperature value for the respective fan is identified, wherein the present temperature value is greater than a lower respective temperature value of the pair of consecutive operating points that defines the respective present temperature slot for the respective fan, and lower than a higher respective temperature value of the pair of consecutive operating points that defines the respective present temperature slot for the respective fan;

calculate a respective desired RPM value according to a specified algorithm and the pair of consecutive operating points that defines the respective present temperature slot for the respective fan; and output the respective desired RPM value.

* * * * *